United States Patent [19]

Uibel

[11] Patent Number: 4,463,472

[45] Date of Patent: Aug. 7, 1984

[54] DEVICE FOR MOUNTING A LID ON A HOUSING OF A VACUUM CLEANER

[75] Inventor: Paul-Ulrich Uibel, Ennepetal, Fed. Rep. of Germany

[73] Assignee: Vorwerk & Co Interholding GmbH, Wuppertal, Fed. Rep. of Germany

[21] Appl. No.: 412,853

[22] Filed: Aug. 30, 1982

[30] Foreign Application Priority Data

Dec. 24, 1981 [DE] Fed. Rep. of Germany ... 8137759[U]

[51] Int. Cl.[3] ..... A47L 5/36

[52] U.S. Cl. ..... 15/327 F; 16/361

[58] Field of Search ..... 15/327 F, 327 R; 16/345, 348, 352, 361, 360, 357

[56] References Cited

U.S. PATENT DOCUMENTS

| | | | |
|---|---|---|---|
| 2,438,133 | 3/1948 | Sparklin | 15/327 F X |
| 3,200,432 | 8/1965 | Voegeli et al. | 15/327 F X |
| 3,440,373 | 4/1969 | Blewitt | 16/361 X |
| 3,682,348 | 8/1972 | Roberts | 16/361 X |

*Primary Examiner*—Chris K. Moore

*Attorney, Agent, or Firm*—Michael J. Striker

[57] ABSTRACT

A mounting device for connecting a lid covering a dust collecting space in a vacuum cleaner to the housing of the vacuum cleaner, which includes two spaced pivotable arms each connected to the lid and supported on an axle slidably positioned in an oblong opening formed in the housing.

2 Claims, 2 Drawing Figures

DEVICE FOR MOUNTING A LID ON A HOUSING OF A VACUUM CLEANER

BACKGROUND OF THE INVENTION

The present invention relates to vacuum cleaners in general, and more particularly to mounting a lid to a vacuum cleaner.

It is known that a dust filter space of a vacuum cleaner usually accommodating a paper bag is covered with a lid or a cover. In conventional constructions such lid has been connected to the housing of the vacuum cleaner so that it could be released and removed from the housing after the lock of the lid had been released.

It has been found that it is not possible to provide a structure in which, for example a socket, i.e. plug, or an indicator would be mounted on the lid, which could connect the lid with the housing by special conduits.

In some conventional structures the lid was provided with a hinge. Requirement has been made to those structures that the lid should be pivoted in the range of about 180° in order to make it possible that a paper bag could be easily inserted into or removed from the dust filter space of the vacuum cleaner. In those conventional designs, however, the pivot point of the hinge tends to come out from the housing of the vacuum cleaner.

It has been also suggested to provide the housing with a web or bar extended outwardly therefrom and to mount the hinge connection on the tip of said web so that the lid overlapped the housing. The disadvantage of this otherwise satisfactory construction is that the mounting arrangement with the lid extends too far upwardly of the housing and thus requires more space.

SUMMARY OF THE INVENTION

It is therefore an object of the present invention to avoid the above disadvantages of conventional mounting devices of the lids of the vacuum cleaners.

It is a further object of the invention to provide an improved vacuum cleaner which is easy in use.

It is still another object of the invention to provide such a mounting device for a lid of a vacuum cleaner which enables the lid to pivot in the range of about 180°.

These and other objects of the invention are attained by a device for connecting a lid for closing a dust filter space of a vacuum cleaner to a housing of a vacuum cleaner, comprising curved arms and pivots, said arms being rigidly connected to said lid and being each pivotally mounted on the respective pivot about said housing, said housing being formed with oblong openings, said pivots each being slidably positioned in the respective ablong opening, whereby said lid can pivot between its open position and its closed position in the range of about 180°.

In accordance with further features of the invention the housing may be provided with sloped surfaces; the arms which have curved outer surfaces can be adapted to slide by said outer surfaces along respective sloped surfaces during the pivoting movement of the lid between its open and closed positions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
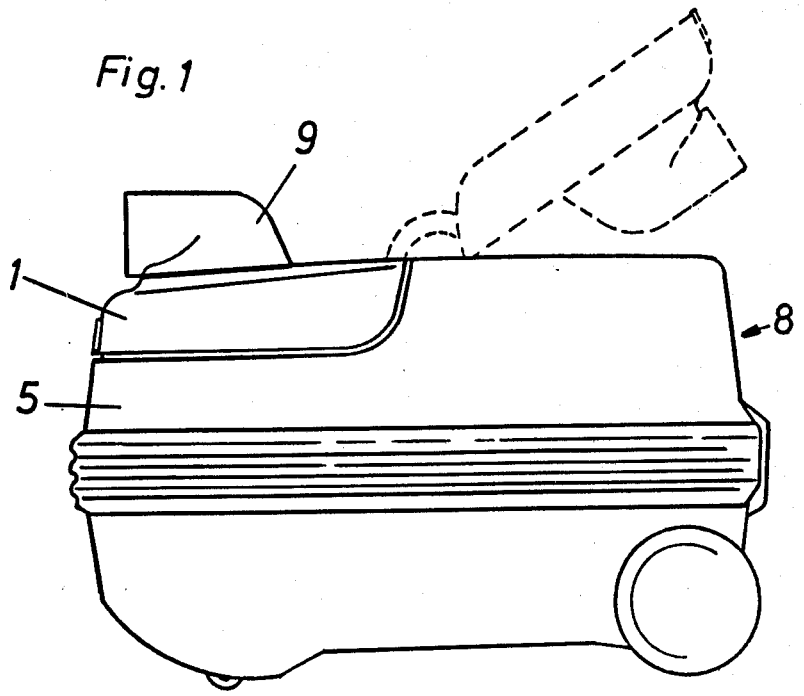
FIG. 1 is a schematic side view of a vacuum cleaner according to the invention.

Referring now to the drawings, it will be seen that a vacuum cleaner 8 of a known per se type includes a housing 5 into which a paper bag for collecting dust is normally inserted and a lid 1 which covers a dust filter space (not illustrated herein) in the interior of the housing. Lid 1 carries a suction support 9 for connecting thereto a suction hose not shown in the drawing and, of course, known in the art. The lid 1 shown in dotted lines is in its open position.

It has been recognized that for the sake of convenience the lid should be pivoted at an angle of about 180°, so that in the closed position it would be flush with the outer surface of the housing.

The connecting arrangement of the lid according to the invention provides for such pivoting range.

Figure 2:
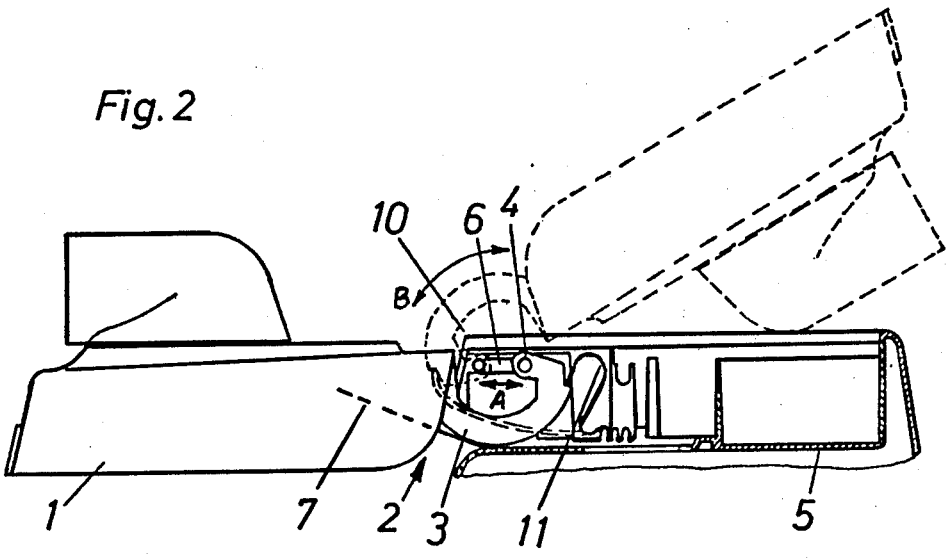
FIG. 2 is a schematic view, partially in section of the vacuum cleaner with a portion removed and illustrating a lid of the vacuum cleaner in its closed and open positions.

Reference is now made to FIG. 2 in which a partial sectional view of the housing 5 of the vacuum cleaner is depicted. Lid 1 at one of its ends is provided with two curved arms 3 which are spaced from each other in a transverse direction and thus disposed at two opposite sides of the housing 5. Only one arm 3 is illustrated in FIG. 2. It should be understood, however, that a simular mounting arrangement is provided for a second arm 3, positioned on the side of the housing not shown in the drawing. Arm 3 is pivotally supported on a pivot or axle 4 about which it can be pivoted. Axle 4 is positioned in an oblong opening 6, formed in the housing 5 of the vacuum cleaner. Axle 4 can move axially in the oblong opening 6 in two opposite directions shown by arrows A.

The housing 5 is further provided with sloped projections or guide surfaces 7 against which the curved outer surface of the respective arm 3 lies. Only one sloped surface 7 is shown; a respective second sloped surface is provided for the second arm 3. Arm 3 can move along the surface 7 as axle 4 is moved to the left (in the plane of the drawing). Thus lid 1 can pivot to its open position shown in dotted lines about an edge 10 of the housing 5.

In order to close lid 1 the latter will be pivoted in a reverse direction, e.g. to the left (in the plane of the drawing). The curved portion of arm 3 will then move or slide along the sloped surface 7 in a backward direction and will push axle 4 to the right so that the lid 1 will be closed.

Arm 3 can be formed as a hollow member so as to provide therein a guide for guiding an electric lead 11.

It will be understood that each of the elements described above, or two or more together, may also find a useful application in other types of vacuum cleaners differing from the types described above.

While the invention has been illustrated and described as embodied in a vacuum cleaner, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be prosecuted by Letters Patent is set forth in the appended claims:

1. A device for connecting a lid for closing a dust filter space of a vacuum cleaner to a housing of the vacuum cleaner, comprising two curved arms spaced from each other in a direction transversal to the elongation of the housing of the vacuum cleaner and rigidly connected to the lid, said housing being formed with two oblong openings, said curved arms each carrying a pivot axle positioned in each of said oblong openings so that each pivot axle can slide within the respective opening between one end position and another end position, said curved arms being pivotable about the pivot axles when the pivot axles are in the one end position so as to permit said lid to pivot relative to said housing between an open position and a closed position in the range of about 150°.

2. The device as defined in claim 1, wherein said housing has sloped surfaces, each of said arms having a curved outer surface which is adapted to slide along the respective sloped surface of the housing while said pivot axles slide within the respective oblong openings.

* * * * *